US005218850A

United States Patent [19]

Davi

[11] Patent Number: 5,218,850

[45] Date of Patent: Jun. 15, 1993

[54] ROLL BENDING MACHINE

[75] Inventor: Orazio M. Davi, Cesena, Italy

[73] Assignee: Promau S.R.L., Cesena, Italy

[21] Appl. No.: 763,239

[22] Filed: Sep. 20, 1991

[30] Foreign Application Priority Data

Sep. 28, 1990 [IT] Italy ..... 14727 B/90

[51] Int. Cl.[5] ..... B21D 5/14

[52] U.S. Cl. ..... 72/171; 72/173; 72/241.4

[58] Field of Search ..... 72/171, 173-175, 72/170, 169, 166, 163, 165, 241.4, 242.2

[56] References Cited

U.S. PATENT DOCUMENTS

| | | | |
|---|---|---|---|
| 160,647 | 3/1875 | Chapman | 72/175 |
| 1,614,425 | 1/1927 | Coe | 72/241.4 |
| 1,787,558 | 1/1931 | Tinsman | 72/242.2 |
| 2,877,821 | 3/1959 | Potter | 72/174 |
| 2,995,171 | 8/1961 | Hausler | 72/175 |
| 3,564,889 | 2/1971 | Herburg . | |
| 4,074,555 | 2/1978 | Noe | 72/163 |
| 4,312,208 | 1/1982 | Schafer | 72/166 |
| 4,491,004 | 1/1985 | Ivanoff | 72/171 |

FOREIGN PATENT DOCUMENTS

| | | | |
|---|---|---|---|
| 2334436 | 1/1975 | Fed. Rep. of Germany . | |
| 2903990 | 8/1980 | Fed. Rep. of Germany . | |
| 3443851 | 6/1986 | Fed. Rep. of Germany . | |
| 134676 | 1/1880 | France | 72/169 |
| 23775 | 7/1972 | Japan | 72/174 |
| 24761 | 2/1980 | Japan | 72/170 |
| 49861 | 8/1921 | Sweden | 72/174 |
| 822946 | 4/1981 | U.S.S.R. | 72/163 |

*Primary Examiner*—Daniel C. Crane
*Attorney, Agent, or Firm*—Young & Thompson

[57] ABSTRACT

A roll bending machine for bending plates or iron sheets comprising an upper roll for dragging the plate, a central gripping roll and lateral bending rolls beneath the upper roll, wherein the flexure of each roll of the bending machine is opposed by a longitudinal beam and by a plurality of rolling members disposed between each roll and the longitudinal support beam. The rolling members are mounted in pairs which are individually adjustable relative to their associated beam in directions toward and away from the beam.

6 Claims, 3 Drawing Sheets

ROLL BENDING MACHINE

BACKGROUND OF THE INVENTION

The present invention relates to roll bending machines for bending plates with four shaping rolls, of the type comprising an upper roll for dragging the plate to be bent, a central gripping roll and lateral bending rolls placed below the upper roll, wherein said central and lateral rolls are movably supported towards the upper roll dragging the plate.

In roll bending machines, the strictest working limit is represented by the minimum bend radius which can be obtained on the plate which the machine has to bend.

This limit mainly depends on the diameter of the upper roll of the bending machine as well as on the distance between the axes of the lower rolls which must be predefined at the design stage. The plate does in fact have to be rolled around the upper dragging roll in order to be bent into a tubular shape. As a result the diameter of the upper roll defines a working limit below which the plate cannot be physically bent. On the contrary, in view of the "spring back" of the plate, the minimum working diameter which can be obtained is generally greater than the diameter of the upper roll by a given coefficient.

When designing a bending machine the rolls must likewise be dimensioned with a fully defined diameter which takes into account the loads and stresses which working the plate causes to the rolls themselves. The greater the thickness and the dimensions of the plates to be worked, the higher the stresses and the strains acting on the rolls and, consequently, the greater the resulting diameter of the rolls themselves must be.

Another element which conditions the diameter of the rolls of a bending machine is represented by the flexure which the same rolls undergo due to the forces which they exert during working. In fact, if the flexure of the rolls is too high, albeit without involving risks for the rolls themselves, the result of working would be of poor quality and unacceptable since the bent plate would be deformed or would lack the required cylindricity since, due to the excessive flexure of the rolls, a bend with the so-called "barrel effect" would be obtained.

Therefore the rolls of a bending machine must be designed and dimensioned not only to an extent such as to withstand the high stress forces which act during the bending operations, but also in order not to flex excessively.

The actual length of the bending machine affects the flexure of the rolls and hence the diameter of the rolls themselves. Therefore, in bending machines of considerable length, for the purpose of limiting the flexure of the rolls within acceptable values, the diameter has to be increased by introducing further restrictions to working.

These working limits and restrictions of roll bending machines are accepted unwillingly due to the increasingly felt requirement for bending machines capable of offering the maximum working potential.

It would therefore be desirable to have roll bending machines also capable of working plates of considerable length, and with bend radii which are as small as possible.

The plate bending machines of the type mentioned, currently available, are not able to fulfil these requirements.

For this reason special expedients or bending machines of another kind have to be used, with considerably high working costs and with results whose quality is at times poor. In fact the only possibility currently allowed, besides that of using machines of another kind, is of using very short bending machines for bending a high number of plates which then have to be welded side by side with high production costs and with technical and aesthetic results which are not always acceptable by users.

The object of the present invention is to provide a roll bending machine suitable for solving the problems mentioned previously; more precisely a main object of the present invention is to provide a roll bending machine by means of which it is possible to reduce the diameter and the distances between the axes and the rolls in order to overcome the working limits found with traditional roll bending machines.

A further object of the present invention is to provide a roll bending machine, as specified above, which in addition to being able to withstand high forces and stresses, also allows the diameter of the rolls to be reduced to a minimum, maintaining the flexure of the rolls themselves within acceptable limits.

A still further object of the present invention is to provide a roll bending machine, as related, by means of which it is possible to bend plates with extremely small bend radii, and smaller than those which can be currently obtained with traditionally or standard use bending machines.

SUMMARY OF THE INVENTION

The above can be achieved by means of a roll bending for bending plates or iron sheets comprising an upper roll for dragging the plate, a central gripping roll and lateral bending rolls beneath the upper roll, wherein the flexure of each roll of the bending machine is opposed by a longitudinal beam and by a plurality of rolling members disposed between each roll and the longitudinal support beam.

BRIEF DESCRIPTION OF THE DRAWINGS

A preferred embodiment of a roll bending machine according to the present invention, is described hereinunder with reference to the figures in the accompanying drawings, in which.

DESCRIPTION OF THE DRAWINGS

Figure 1:
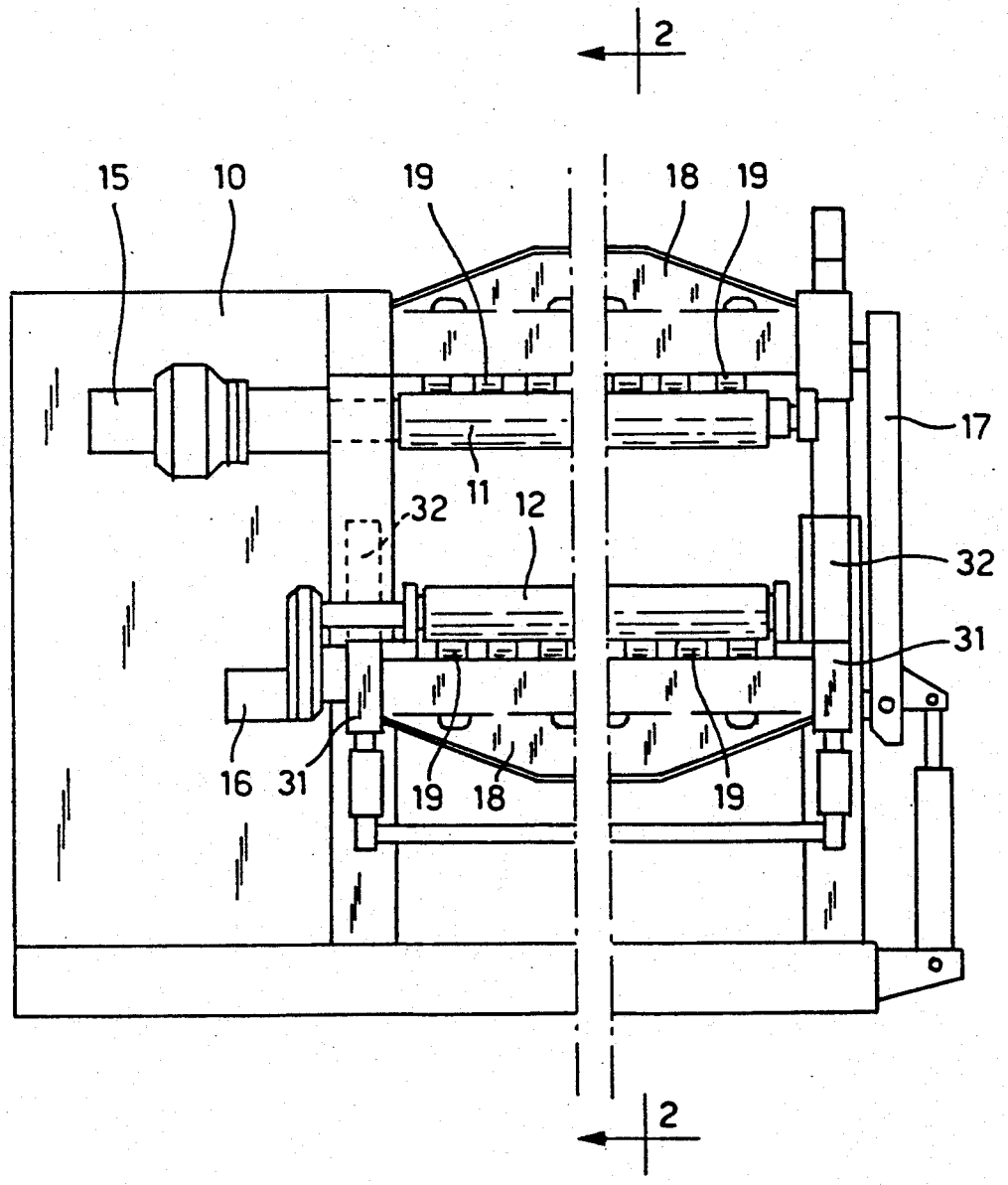
FIG. 1 is a schematic view, in a longitudinal plane, of a roll bending machine according to the invention.
Figure 2:
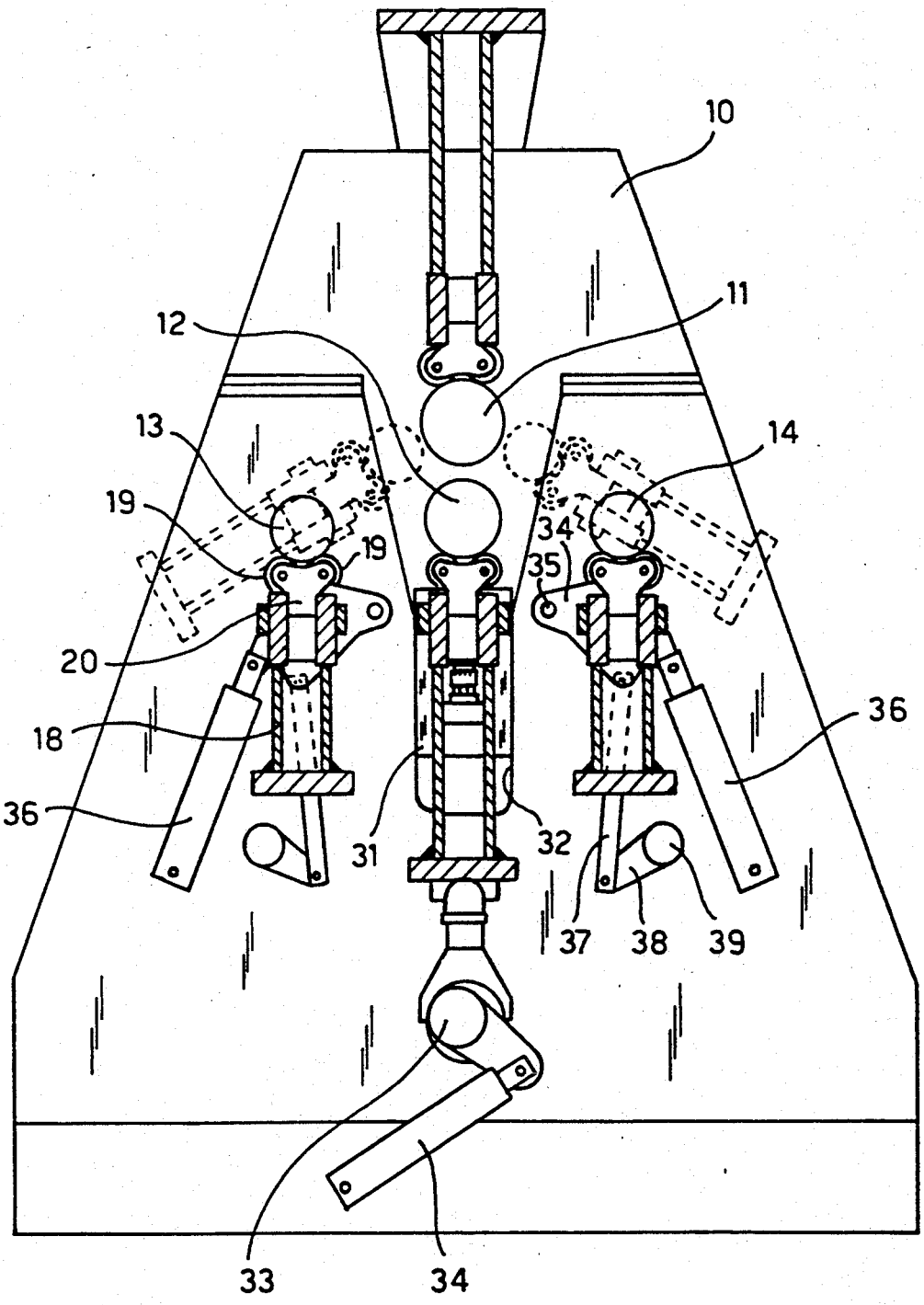
FIG. 2 is a cross-sectional view along line 2—2 of FIG. 1 with some parts removed.

With reference first to FIGS. 1 and 2, we will now describe the general characteristics of a roll bending machine, according to the present invention.

In general a roll bending machine comprises a structure 10 for supporting four shaping rolls, more precisely an upper roll 11, and three lower rolls, of which a central roll 12 and two lateral rolls 13 and 14 arranged with an appropriate distance between their axes.

The upper roll 11, also known as to plate dragging roll and, optionally, the lower roll 12, also known as to gripping roll, are suitably connected to hydraulic driving motors 15 and 16 respectively, via gearing down units for dragging and guiding in rotation a plate or iron sheet which has to be bent around the upper roll.

As explained hereinunder, the lower rolls of the bending machine, that is to say the gripping roll 12 and the lateral bending rolls 13 and 14, are movably supported towards the upper roll 11. The machine is fitted with all those devices required for its working, as for example the device 17 for opening the upper roll in order to remove the plate after it has been bent, and all the necessary control devices which are not explicitly described or illustrated since they do not form a substantial part of the present invention.

As related previously, for the purpose of maintaining the diameter of the rolls of the bending machine comparatively small, at the same time preventing the rolls from being damaged or from undergoing undesiderable flexures even when they are subjected to considerable forces and stresses, according to the main characteristic of the present invention each roll 11, 12, 13 and 14 of the bending machine has been provided with an anti-flexure support in the form of a beam 18 which extends longitudinally and parallel to the same roll on the rear side which is opposite to the one touching the plate; a set of rolling members 19, for example in the form of support rollers having a small diameter, are positioned between each roll of the bending machine and the anti-flexure support beam related to it. In this way, unlike traditional bending machines, the individual rolls 11, 12, 13 and 14, instead of being simply supported at their ends, according to the invention they rest in several points, along their entire length, arranging the support rollers 19 placed apart so as to release all the stresses on the anti-flexure beam 18. The number, the position and the dimensions of the support rollers 19 may vary depending on the dimensions of the roll bending machine.

Hereinunder we will describe in greater detail a preferred embodiment of an anti-flexure support according to the present invention, referring by way of an example to the lateral roll 13, without prejudice to the fact that the anti-flexure supports of the remaining rolls have identical or similar characteristics to those described hereinunder.

Figure 3:
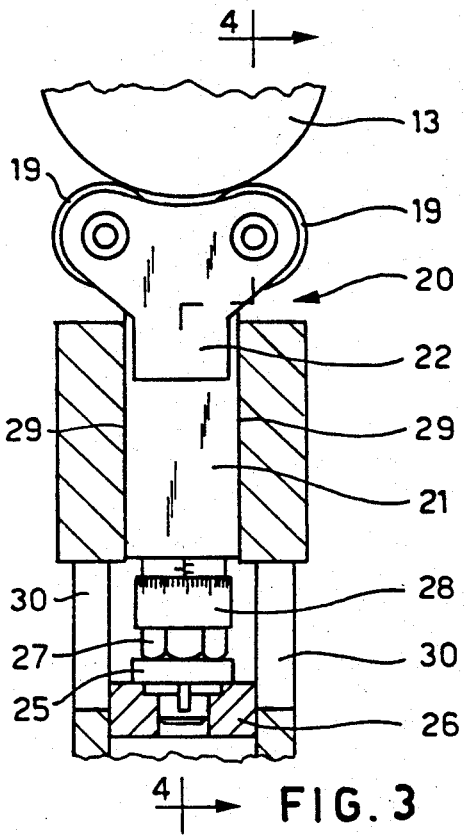
FIG. 3 is an enlarged detail of a beam for supporting the rolls of FIG. 2.
Figure 4:
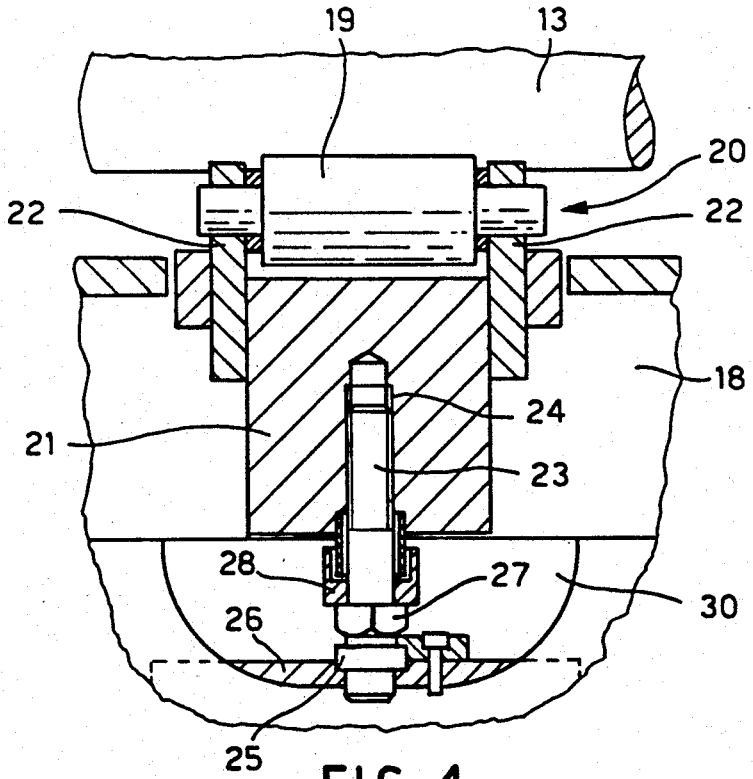
FIG. 4 is a longitudinal sectional view along line 4—4 of FIG. 3.

As shown in FIGS. 2, 3 and 4, the anti-flexure support 18 for the roll 13 of the bending machine, is in the form of a longitudinal beam which is trapezoidal in shape and suitably stiffened and structured to withstand the forces and stresses transmitted by the roll 13 during the bending of a plate.

More particularly, the roll 13 is rotatably supported at its ends by the same anti-flexure beam 18 as well as by two sets of intermediate support rollers 19 arranged symmetrically on the two sides of the longitudinal plane of symmetry of the beam 18 which coincides with the longitudinal axis of the roll 13. Each roller 19 for supporting the shaping roll 13 of the bending machine, is freely rotatable and it is adjustably supported by means of a slider 20 by which it is also possible to give an indication of the adjusted position. The slider 20 is suitably guided inside the anti-flexure beam 18 and is shown in greater detail in FIGS. 3 and 4 of the accompanying draggings.

More particularly, as shown in the aforementioned figures, each slider 18, for the rolls 19 of the anti-flexure beam, comprises a guide block 21 having plane guide surfaces and provided with two lateral forks 22 which project upwards beyond the beam 18 to support the pair of support rollers 19.

The block 21 is guided on the sides by internal guide surfaces 29 of the beam to slide and be adjusted in height to the required position. The block 21, or the entire support 20 for each pair of rollers 19, fully releases the forces and the stresses onto the beam 18, resting on an internal cross member 26 by means of a large threaded stem 23, which on one side is screwed into a threaded hole 24 of the block 21, while on the other it has an annular flange 25 resting against the internal cross member 26 of the anti-flexure beam. The stem 23, a short distance from the support flange 25, has a hexagonal head 27 by means of which it can be made to rotate to adjust the position in height of the rolls 19, in relation to the shaping roll 13 of the bending machine, while an indexing ring nut 28 fixed to the block 21 is provided with an appropriate scale which, by means of a similar linear scale on the stem 23 allows evaluation of the displacement and hence of the degree of regulation of the support rollers 19 for the roll 13. The perfect planarity and the parallel nature of the guide surfaces of each slider 20, enable the rollers 19 to be maintained in a perfectly symmetrical position in relation to the axis of the roll 13 which is thus supported in an appropriate manner in order to prevent any flexure of its axis.

For the purpose of acting on the threaded stems 23 of each slider, to regulate variously the position of the support rollers 19 at each slider 20, the beam 18 has suitable lateral openings 30 through which a tool can be inserted.

In the specific case a particular solution has been shown as regards the means for adjusting the position of the support rollers 19 for the shaping rolls of the bending machine, nevertheless it is understood that other solutions are possible within the scope of the present invention.

As mentioned initially, the lower gripping roll 12 and the two lateral bending rolls 13 and 14 must be supported to move towards the upper dragging roll 11. Therefore, according to a further characteristic of the present invention, each roll of the bending machine is movable with the relative anti-flexure beam in such a way as to form a unitary system within which the stresses and tensions caused by possible flexures of deformations of the roll are released; in this way all the stresses acting on the rotation bearings of the rolls and the oscillation bearings of the support beam are substantially reduced or eliminated.

More particularly, as shown for example in FIGS. 1 and 2 for the central gripping roll 12, each roll of the bending machine is supported in a rotatory manner directly at the ends of the anti-flexure beam 18 which is in turn rigidly connected, for example welded, to two slides 31 which can move in vertical guideways 32 at the two heads of the machine. The roll 12 can be supported in an idle rotatory manner by the beam 18 or, preferably, it can be connected to a driving motor 16 which in turn is movable with the beam 18 or with the respective slide 31. The vertical movement of raising and lowering the entire assembly of the roll 12 and of its anti-flexure beam 18 may be obtained in any suitable manner, for example by means of a cam system 33 connected to a hydraulic driving cylinder 34 at each end of the anti-flexure beam 18.

In a substantially similar manner, each of the two lateral bending rolls 13 and 14, as shown in the right-hand part of FIG. 2 for the roll 14, is supported in an idle rotatory manner by the respective anti-flexure beam which in turn is rigidly connected to two end plates 34 (only one is shown in FIG. 2), hinged in 35 to the structure of the machine in order to rotate along an axis parallel to the axis of the same roll, as shown by the dotted line in FIG. 2. The rotational movement of the entire assembly of the lateral roll 13, 14 and of the relative anti-flexure beam 18, is also achieved in this case by means of hydraulic cylinders 36, suitably connected to a source of pressurized fluid. In order to always ensure a perfectly horizontal and parallel arrangement of each roll, that is to say for the purpose of ensuring an arrangement parallel to the rolls of the bending machine, the two rocking plates 34 of the lateral rolls are connected by means of a connecting rod 37 and a lever 38 to a torsion bar 39 which reacts to ensure this parallel arrangement.

From what has been said and shown in the accompanying drawing, it is therefore clear that the provision to each shaping roll of the bending machine of its own anti-flexure beam with sets of support or bucking rollers placed between each shaping roll of the bending machine and the anti-flexure beam itself, enables the diameter of the shaping rolls to be reduced considerably, even on machines of considerable length.

Figure 5:
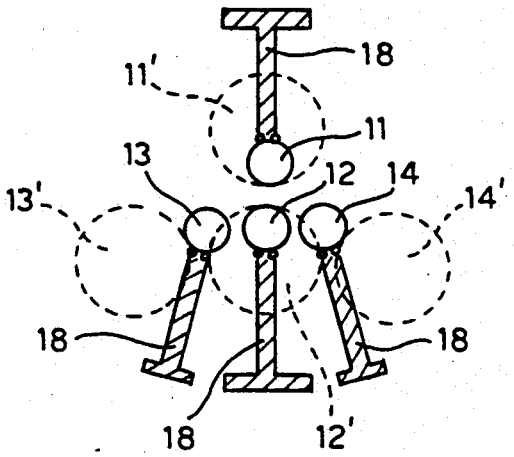
FIG. 5 is a diagram which compares the arrangement and the dimensions of the rolls of a roll bending machine according to the invention, with those of a traditional roll bending machine.

Furthermore, the fact that shaping rolls with very small diameter, in relation to rolls on traditional machines, can be mounted, allows a further advantage which consists in the fact that distances between the axes of the lower rolls are reduced considerably. This is shown, by way of an example, in the diagram in FIG. 5 where the dimensions and the positions of the shaping rolls 11, 12, 13 and 14 of a bending machine according to the invention are compared with corresponding rolls 11', 12', 13' and 14' of a traditional bending machine. All this leads to the advantage of being able to bend plate having very small bend radii, avoiding damaging and dangerous deformations in the upper rolls of the same bending machine.

It can be understood therefore that what has been said and shown in the accompanying draggings has been given merely by way of an example of the general principles of the invention which is claimed.

What is claimed is:

1. A roll bending machine for bending metal plate, said machine having upper and lower opposed working rolls defining between them a roll nip, lateral shaping rolls on opposite sides of said lower working roll, said lateral shaping rolls bending a metal plate about said upper working roll, and on the side of each said lateral shaping roll opposite said roll nip a support beam extending parallel to the lateral shaping roll, a plurality of rolling means mounted for rotation on each said beam and spaced apart lengthwise of said beam and adapted to contact said lateral shaping rolls to back up said lateral shaping rolls, means for selectively individually adjusting the distance of said rolling means from said beams, means mounting each beam of each said lateral shaping roll for rocking movement about an axis which is parallel to said working rolls and which is spaced from and parallel to the axis of the associated shaping roll, and an anti-torsion bar connected by articulated levers to opposite ends of the beam of each said lateral shaping roll to maintain parallelism of each lateral shaping roll during said rocking motion.

2. A roll bending machine as claimed in claim 1, said rolling means comprising rollers having axes parallel to the working rolls and in rolling contact with the working rolls.

3. A roll bending machine as claimed in claim 1, said rolling means each comprising a pair of rollers mounted for conjoint movement on a said beam toward and away from said beam, each said pair of rollers contacting a said working roll at points peripherally spaced apart around said working roll.

4. A roll bending machine as claimed in claim 3, each roller of each said pair of rollers being mounted for rotation on and relative to a slider that slides within an associated said beam.

5. A roll bending machine as claimed in claim 4, there being planar guide surfaces within said beam for guiding said slider for sliding movement relative to said beam.

6. A roll bending machine as claimed in claim 4, each slider having a screw threaded stem engaging in a threaded hole in a member rotatable relative to the associated said beam for moving the slider toward and away from the beam.

* * * * *